US011348397B2

(12) United States Patent
Zhou et al.

(10) Patent No.: US 11,348,397 B2
(45) Date of Patent: May 31, 2022

(54) VENDING MACHINE

(71) Applicants: Shandong New Beiyang Information Technology Co., Ltd., Shandong (CN); Weihai New Beiyang Digital Technology Co., Ltd., Shandong (CN)

(72) Inventors: Chong Zhou, Shandong (CN); Xinping Wang, Shandong (CN); Tengfei Zhang, Shandong (CN); Qiangzi Cong, Shandong (CN); Tianxin Jiang, Shandong (CN); Chuntao Wang, Shandong (CN)

(73) Assignees: Shandong New Beiyang Information Technology Co., Ltd; Weihai New Beiyang Digital Technology Co., Ltd.

( * ) Notice: Subject to any disclaimer, the term of this patent is extended or adjusted under 35 U.S.C. 154(b) by 0 days.

(21) Appl. No.: 17/266,982

(22) PCT Filed: Aug. 9, 2019

(86) PCT No.: PCT/CN2019/099935

§ 371 (c)(1),
(2) Date: Feb. 8, 2021

(87) PCT Pub. No.: WO2020/030086

PCT Pub. Date: Feb. 13, 2020

(65) Prior Publication Data

US 2021/0312750 A1 Oct. 7, 2021

(30) Foreign Application Priority Data

Aug. 9, 2018 (CN) ..... 201810902854.7

(51) Int. Cl.
*G07F 11/16* (2006.01)
*G07F 9/02* (2006.01)

(52) U.S. Cl.
CPC ..... *G07F 11/16* (2013.01); *G07F 9/026* (2013.01); *G07F 11/1653* (2020.05)

(58) Field of Classification Search
CPC ..... G07F 11/165; G07F 11/1653
See application file for complete search history.

(56) References Cited

U.S. PATENT DOCUMENTS 4,108,333 A * 8/1978 Falk ..... G07F 11/58 221/13
6,415,950 B1 * 7/2002 Robrechts ..... G07F 11/42 221/124

(Continued)

FOREIGN PATENT DOCUMENTS

CN 105785875 A 7/2016
CN 205451288 U 8/2016

(Continued)

OTHER PUBLICATIONS

International Search Report and Written Opinion issued in related International Application Serial No. PCT/CN2019/098417 dated Oct. 31, 2019, 7 pages.

(Continued)

*Primary Examiner* — Timothy R Waggoner
(74) *Attorney, Agent, or Firm* — Mark H. Whittenberger, Esq.; Holland and Knight LLP

(57) ABSTRACT

Provided is a vending machine. The vending machine includes a control device, a cabinet, an item column, and a hopper. The hopper is located between the item column and a pickup port of the cabinet. The hopper includes a receiving bin provided with an opening. The vending machine further includes a detection device. The control device is configured to control the receiving bin to receive the item from the item column at a receiving position based on a purchase instruction from a user, and control the receiving bin to rotate from the receiving position to a first position located between the (Continued)

receiving position and the dispensing position based on the detection result that the item exists at the inlet of the hopper.

18 Claims, 3 Drawing Sheets

(56) References Cited

U.S. PATENT DOCUMENTS

| | | | | |
|---|---|---|---|---|
| 6,755,322 | B1 * | 6/2004 | Herzog | G07F 11/1653 221/123 |
| 2010/0312437 | A1 * | 12/2010 | Saito | E02F 3/434 701/50 |

FOREIGN PATENT DOCUMENTS

| | | | |
|---|---|---|---|
| CN | 106327679 | A | 1/2017 |
| CN | 206179093 | U | 5/2017 |
| CN | 206179102 | U | 5/2017 |
| CN | 206638346 | U | 11/2017 |
| CN | 207337527 | U | 5/2018 |
| JP | 2011209812 | A | 10/2011 |
| JP | 2012027771 | A | 2/2012 |
| WO | 2005109355 | A2 | 11/2005 |

OTHER PUBLICATIONS

First Chinese Office Action issued in related International Chinese Patent Application No. 201810902854.7 dated Jul. 31, 2020, 13 pages.

* cited by examiner

VENDING MACHINE

RELATED APPLICATIONS

The subject application is a U.S. National Stage application of International Application No. PCT/CN2019/099935, filed on 9 Aug. 2019, which claims the priority of Chinese Patent Application No. 201810902854.7, filed on 9 Aug. 2018, the contents of which are herein incorporated by reference in their entirety.

TECHNICAL FIELD

The present disclosure relates to the technical field of vending, for example, a vending machine.

BACKGROUND

A vending machine is a commercial automation device used for automatically selling items. Since the vending machine is not restricted by time and place and has the advantages of saving labor, facilitating transactions, and the like, the vending machine is more and more widely used.

A vending machine in the related art is described as follows. This vending machine includes an item column for accommodating items, a pickup port, and a hopper for delivering items between the item column and the pickup port. The hopper has a frame structure. The hopper includes an inlet and an outlet disposed opposite to the inlet. In the case where the vending machine dispenses items, the hopper is first driven to the item column such that the inlet of the hopper faces to the outlet of the item column, and then the items in the item column are sent into the inside of the hopper through the inlet of the hopper, and finally, the hopper is driven to the pickup port such that the outlet of the hopper faces to the pickup port so that the user can take the items away through the pickup port and the outlet of the hopper.

However, the items in the item column of the vending machine in the related art may tilt when entering the hopper from the item column. In the case where the rear end of the tilted items protrudes from the inlet of the hopper and reaches the outside of the hopper, the items protruding from the inlet of the hopper hinder the normal movement of the hopper between the item column and the pickup port, causing the vending machine to work abnormally. Therefore, the vending machine in the related art has the following problem: the items in the hopper protrude from the inlet of the hopper and thus the vending machine may work abnormally.

SUMMARY

This article provides a vending machine to solve the following problem of the vending machine in the related art: the item in a hopper protrudes from the inlet of the hopper and reach the outside of the hopper, causing the vending machine to work abnormally.

Embodiments of the present disclosure are achieved in the manners described below.

Provided is a vending machine, including a control device, a cabinet, a pickup port disposed on the cabinet, an item column, and a hopper. The item column and the hopper are disposed inside the cabinet. The hopper is located between the item column and the pickup port. The hopper is configured to deliver items between the item column and the pickup port. The hopper is provided with an inlet and an outlet. The hopper includes a receiving bin provided with an opening. The receiving bin is rotatable between a receiving position and a dispensing position. The receiving position is the position of the receiving bin when the hopper receives an item from the item column. The dispensing position is the position of the receiving bin when a user takes out the item from the hopper. The vending machine further includes a detection device. The detection device is configured to detect whether an item exists at the inlet of the hopper. The detection device is electrically connected to the control device. The control device is configured to control the receiving bin to receive an item from the item column at the receiving position according to a purchase instruction from a user. The control device is further configured to detect whether the item exists at the inlet of the hopper, and control the receiving bin to rotate from the receiving position to a first position located between the receiving position and the dispensing position based on the detection result that the item exists at the inlet of the hopper.

BRIEF DESCRIPTION OF DRAWINGS

The drawings used in the description of the embodiments will be briefly described below. It is to be understood that the subsequent drawings only illustrate part of embodiments of the present disclosure, and therefore should not be construed as limiting the scope. Those of ordinary skill in the art may obtain other drawings based on the drawings described below on the premise that no creative work is done.

REFERENCE LIST

Figure 1:
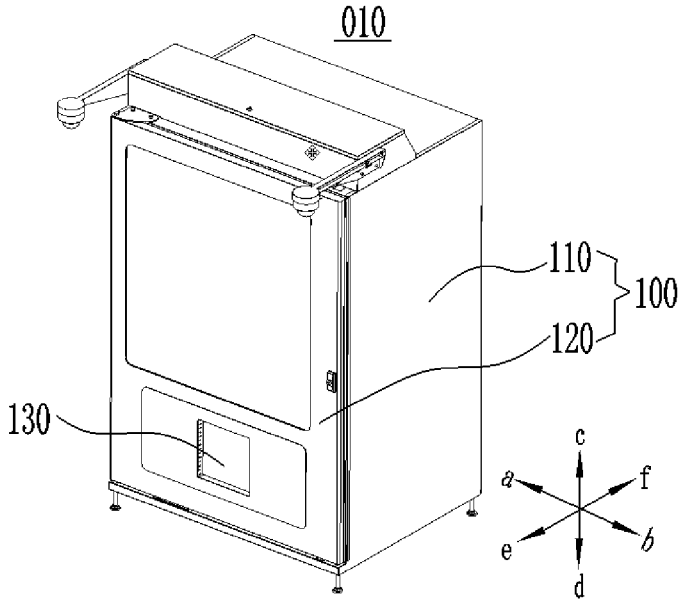
FIG. 1 is an external structural schematic view of a vending machine according to an embodiment of the present disclosure.

010 vending machine
100 cabinet
110 cabinet body
120 cabinet door
130 pickup port
200 storage device
210 item column
211 item conveying mechanism
300 delivery device
310 hopper
311 frame
311*a* inlet
311*b* outlet
312 receiving bin

312*a* opening
312*b* front wall
312*c* rear wall
312*d* bottom plate
313 shaft
314 receiving bin driving mechanism
315 baffle
320 hopper driving mechanism
321 horizontal driving mechanism
322 vertical driving mechanism
400 detection device
410 photoelectric sensor
500 control device
600 alarm device

DETAILED DESCRIPTION

The solutions in embodiments of the present disclosure will be clearly and completely described in conjunction with the drawings in the embodiments of the present disclosure. Apparently, the embodiments described below are part, not all, of the embodiments of the present disclosure. Generally, the components in the embodiments of the present disclosure described and illustrated in the drawings herein may be arranged and designed through various configurations.

Therefore, the following detailed description of the embodiments of the present disclosure shown in the drawings is not intended to limit the scope of the present disclosure, but merely illustrates the selected embodiments of the present disclosure. Based on the embodiments described herein, all other embodiments obtained by those of ordinary skill in the art without creative work are within the scope of the present disclosure.

It is to be noted that similar reference numerals and letters indicate similar items in the subsequent drawings, and therefore, once a particular item is defined in one drawing, the item needs no more definition and explanation in subsequent drawings.

In the description of the embodiments of the present disclosure, it is to be noted that the orientational or positional relationships indicated by terms "center", "above", "below", "left", "right", "vertical", "horizontal", "inside", "outside" and the like are based on the orientational or positional relationships illustrated in the drawings or the orientational or positional relationship that products of the present disclosure are usually used in, which are for the mere purpose of facilitating and simplifying the description of the present disclosure and do not indicate or imply that the device or element referred to has a specific orientation and is constructed and operated in a specific orientation, and thus it is not to be construed as limiting the present disclosure. Moreover, terms "first", "second" and "third" are merely for distinguishing the description and are not to be construed as indicating or implying relative importance.

Solutions of the present disclosure are further described below through the embodiments in conjunction with the drawings.

Figure 2:
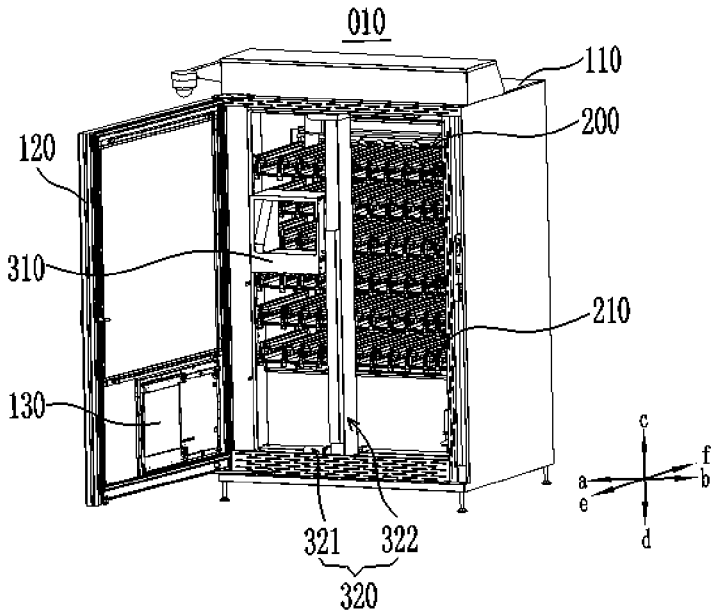
FIG. 2 is an internal structural schematic view of the vending machine according to an embodiment of the present disclosure.
Figure 3:
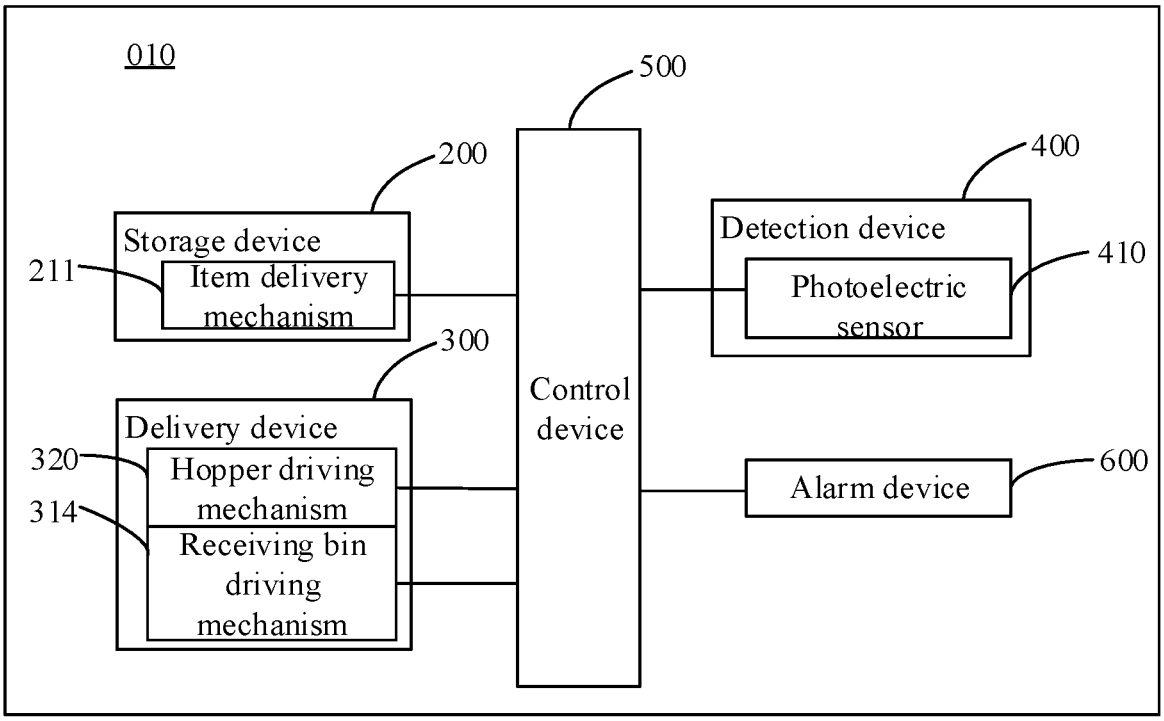
FIG. 3 is a component block diagram of the vending machine according to an embodiment of the present disclosure.

FIG. 1 is an external structural schematic view of a vending machine according to an embodiment of the present disclosure. FIG. 2 is an internal structural schematic view of the vending machine according to an embodiment of the present disclosure. FIG. 3 is a component block diagram of the vending machine according to an embodiment of the present disclosure. Referring to FIGS. 1 to 3, the vending machine provided in the embodiments of the present disclosure will be described below.

As shown in FIGS. 1 to 3, the vending machine 010 of this embodiment includes a cabinet 100, a storage device 200, a delivery device 300, a detection device 400, a control device 500, and an alarm device 600.

As shown in FIG. 1, the cabinet 100 includes a cabinet body 110 and a cabinet door 120. The cabinet door 120 is movably connected to the cabinet body 110. The cabinet body 110 includes an opening. The cabinet door 120 is movable relative to the opening of the cabinet body 110 such that the opening of the cabinet body 110 is open or closed. The cabinet door 120 is provided with a pickup port 130 for a user to take out an item.

The storage device 200 is configured to accommodate items. As shown in FIG. 2, the storage device 200 is disposed inside the cabinet body 110. The storage device 200 and the cabinet door 120 are oppositely disposed and arranged at an interval. The storage device 200 includes multiple item columns 210 for accommodating items. The multiple item columns 210 are arranged in a number M of layers along the up-down direction (that is, the direction shown by the arrow cd) and are arranged in a number N of rows along the left-right direction (that is, the direction shown by the arrow ab). The length direction of the item column 210 is set to be the front-and-rear direction (that is, the direction shown by the arrow ef). One end of the item column 210 facing toward the cabinet door 120 is provided with an outlet. The outlet of the item column 210 faces to the cabinet door 120. The item column 210 is provided with an item conveying mechanism 211. Under the driving of the item conveying mechanism 211, the items accommodated in the item column 210 can be conveyed out from the outlet of the item column 210.

Figure 4A:
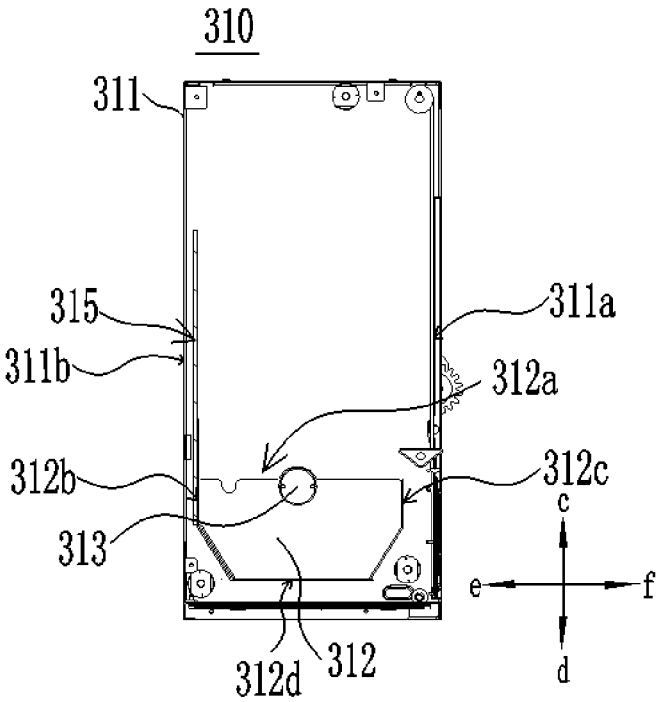
FIG. 4A is a structural schematic view of the hopper of the vending machine according to an embodiment of the present disclosure in the case where a receiving bin is at a receiving position.
Figure 4B:
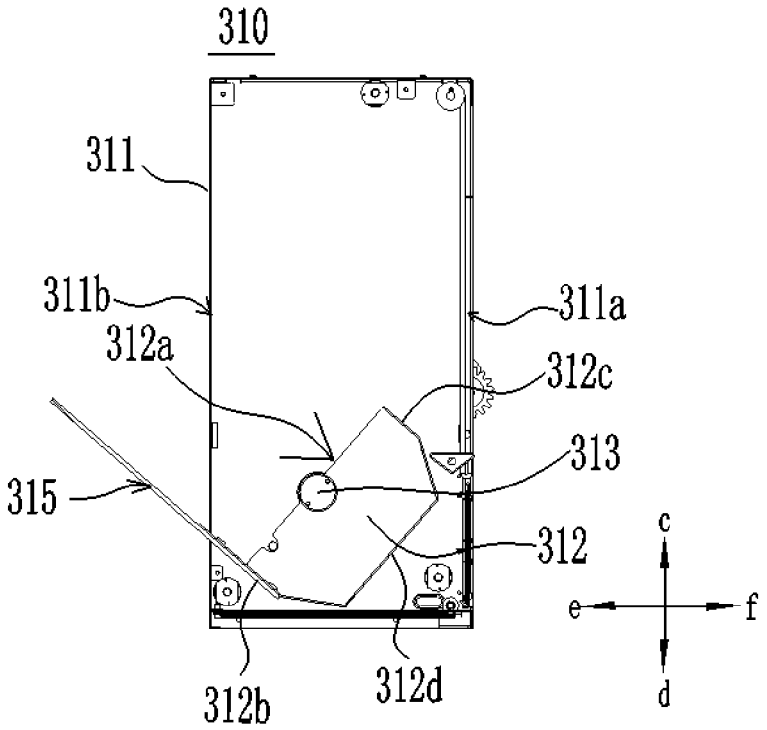
FIG. 4B is a structural schematic view of the hopper of the vending machine according to an embodiment of the present disclosure in the case where the receiving bin is at a dispensing position.

The delivery device 300 is configured to deliver items between the storage device 200 and the pickup port 130. The delivery device 300 is located between the cabinet door 120 and the storage device 200. The delivery device 300 includes a hopper 310. FIG. 4A is a structural schematic view of the hopper of the vending machine according to an embodiment of the present disclosure in the case where a receiving bin is at a receiving position. FIG. 4B is a structural schematic view of the hopper of the vending machine according to an embodiment of the present disclosure in the case where the receiving bin is at a dispensing position. As shown in FIG. 4A and FIG. 4B, the hopper 310 includes a frame 311 and a receiving bin 312. The frame 311 is provided with an item accommodation space penetrating forward and backward. The end surfaces of the frame 311 are provided with an inlet (that is, the inlet 311*a* of the hopper 310) and an outlet (that is, the outlet 311*b* of the hopper 310) of the item accommodation space, respectively. The inlet of the item accommodation space is disposed opposite to the outlet of the item accommodation space. The receiving bin 312 is disposed in the item accommodation space. The receiving bin 312 is pivoted to the frame 311 with a shaft 313. The receiving bin 312 is rotatable around the shaft 313 relative to the frame 311. In some embodiments, the hopper 310 further includes a receiving bin driving mechanism 314. The receiving bin 312 is in a transmission connection with the receiving bin driving mechanism 314. Under the driving of the receiving bin driving mechanism 314, the receiving bin 312 is rotatable between the receiving position and the dispensing position. The receiving position is the position of the receiving bin 312 when the hopper 310 receives the items from the item column 210. The dispensing position is the position of the receiving bin 312 when a user takes out the items from the hopper 310. The receiving bin 312 is provided with an opening 312*a*. As shown in FIG. 4A. In this embodiment, in the case where the receiving bin 312 is located at the receiving position, the opening 312*a* faces upward and the receiving bin 312 can receive the items conveyed out from the item column 210. As shown in FIG. 4B, in the case where the receiving bin 312 is at the dispensing position, the opening 312*a* faces to the outlet 311*b* of the hopper 310 and the user can take out the items in the receiving bin 312 through the opening 312*a*. In other embodiments, in the case where the receiving bin 312 is at the receiving position, the opening 312*a* faces to the inlet 311*a* of the hopper 310. The receiving bin 312 includes a front wall 312*b*, a rear wall 312*c*, a left wall, a right wall, and a bottom plate 312*d*. The bottom plate 312*d*, the front wall 312*b*, the rear wall 312*c*, the left wall, and the right wall of the receiving bin 312 form a semi-closed hopper-shaped accommodation space so that the bottom end of the item is accommodated at the bottom of the receiving bin 312 when the receiving bin 312 rotates. One end of the receiving bin 312 facing toward the outlet 311*b* of the hopper 310 is provided with a baffle 315. In the case where the receiving bin 312 is at the receiving position, the baffle 315 faces to the item column 210 to prevent the items conveyed out from the item column 210 from falling into the outside of the hopper 310 through the outlet 311*b* of the hopper 310. In the case where the outlet 311*b* of the hopper 310 faces to the pickup port 130 and the receiving bin 312 is at the dispensing position, the baffle 315 is inserted into the pickup port 130 to prevent the items in the receiving bin 312 from being jammed between the cabinet door 120 and the receiving bin 312.

In some embodiments, the delivery device 300 further includes a hopper driving mechanism 320. As shown in FIG. 2, the hopper driving mechanism 320 includes a horizontal driving mechanism 321 and a vertical driving mechanism 322. The horizontal driving mechanism 321 and the vertical driving mechanism 322 are electrically connected to the control device 500 and are in a transmission connection with the hopper 310. The horizontal driving mechanism 321 is configured to drive the hopper 310 to move in the left-right direction, and the vertical driving mechanism 322 is configured to drive the hopper 310 to move in the up-down direction so that the inlet 311*a* of the hopper 310 faces to the outlet of any item column 210 or the outlet 311*b* of the hopper 310 faces to the pickup port 130. In the case where the inlet 311*a* of the hopper 310 faces to the outlet of any item column 210, the items in this item column 210 can be sent into the hopper 310. In the case where the outlet 311*b* of the hopper 310 faces to the pickup port 130, the user can take the items in the hopper 310 away through the pickup port 130.

The detection device 400 is configured to detect whether an item exists at the inlet 311*a* of the hopper 310. In this embodiment, the detection device 400 includes at least one photoelectric sensor 410. The photoelectric sensor 410 includes an optical generator and an optical receiver located oppositely on two sides of the inlet 311*a* of the hopper 310. In the case where an item exists at the inlet 311*a* of the hopper 310, the optical path between the optical generator and the optical receiver of the photoelectric sensor 410 is cut off, the optical receiver of the photoelectric sensor 410 cannot receive the light emitted by the optical generator, and the photoelectric sensor 410 outputs a first signal. In the case where no item exists at the inlet 311*a* of the hopper 310, the optical receiver of the photoelectric sensor 410 can receive the light emitted by the optical generator, and the photoelectric sensor 410 outputs a second signal. In an embodiment, the detection device 400 includes multiple photoelectric sensors 410. The optical generator and the optical receiver of each photoelectric sensor 410 are disposed oppositely on the left and right sides of the inlet 311*a* of the hopper 310, respectively. The multiple photoelectric sensors 410 are disposed at intervals in the up-down direction (that is, the direction indicated by the arrow cd) of the hopper 310. In the case where an item exists at the inlet 311*a* of the hopper 310, the optical path between the optical generator and the optical receiver of at least one photoelectric sensor 410 is cut off, and the at least one photoelectric sensor 410 outputs the first signal. In the case where no item exists at the inlet 311*a* of the hopper 310, the optical receiver of each photoelectric sensor 410 can receive the light emitted by a respective light generator, and all the photoelectric sensors 410 respectively output the second signal. Each photoelectric sensor 410 of the detection device 400 is electrically connected to the control device 500 of the vending machine 010. The control device 500 is able to detect whether an item exists at the inlet 311*a* of the hopper 310 according to the signal output by the photoelectric sensor 410. In the case where any photoelectric sensor 410 of the detection device 400 outputs the first signal, the control device 500 determines that an item exists at the inlet 311*a* of the hopper 310. In the case where all the photoelectric sensors 410 of the detection device 400 respectively output the second signal, the control device 500 determines that no item exists at the inlet 311*a* of the hopper 310.

The alarm device 600 is configured to output alarm information to the user. For example, the alarm device 600 is configured to output the alarm information of the abnormality of the hopper to the user. The alarm device 600 may output the alarm information to the user in the form of sound, light, text, pictures, and the like.

The control device 500 is electrically connected to the storage device 200, the delivery device 300, the detection device 400, and the alarm device 600. The control device 500 is configured to control the storage device 200, the delivery device 300, the detection device 400, and the alarm device 600 of the vending machine 010 to work. For example, the control device 500 is configured to control the receiving bin 312 to receive the item from the target item column at the receiving position according to a purchase instruction from a user and to detect whether an item exists at the inlet 311*a* of the hopper 310. In the case where it is detected that an item exists at the inlet 311*a* of the hopper 310, the control device 500 controls the receiving bin 312 to rotate from the receiving position to a first position so that the item completely enters the hopper 310. The first position is located between the receiving position and the dispensing position.

In an embodiment, the vending machine 010 of an embodiment of the present disclosure is used as an example. The control device 500 determines the item to be purchased by the user (hereinafter referred to as the item) according to the purchase instruction from the user, and determines the item column 210 for accommodating the item, that is, the target item column, according to the item; and then the control device 500 controls the hopper driving mechanism 320 of the delivery device 300 to drive the hopper 310 to the target item column so that the inlet of the hopper 310 faces to the outlet of the target item column, and controls the item conveying mechanism 211 in the target item column to drive the item to move a preset distance in the length direction of the target item column, so as to deliver the item into the hopper 310 through the inlet 311*a* of the hopper 310. In the case where the hopper 310 receives the item from the target item column 210, the receiving bin 312 is located at the receiving position to receive the item for sale from the target item column 210.

The control device 500 detects whether an item exists at the inlet 311*a* of the hopper 310 through the signal output by the detection device 400. In an embodiment, after the receiving bin 312 receives the item from the target item column at the receiving position, the control device 500 detects the signal output by the photoelectric sensor 410 of the detection device 400. In the case where it is detected that any photoelectric sensor 410 outputs the first signal, the control device 500 determines that an item exists at the inlet 311*a* of the hopper 310. In the case where it is detected that all the photoelectric sensors 410 respectively output the second signal, the control device 500 determines that no item exists at the inlet 311*a* of the hopper 310.

In other embodiments, other methods may also be used to detect whether an item exists at the inlet of the hopper 310. For example, a camera device is disposed in the hopper 310, the image of the item entering the hopper 310 is captured by the camera device, and it is determined whether an item exists at the inlet of the hopper 310 according to the image of the item. For example, in the case where it is determined that the item is located at or protrude from the inlet of the hopper 310 according to the image of the item, it is determined that an item exists at the inlet of the hopper 310; otherwise, it is determined that no item exists at the inlet of the hopper 310.

In this embodiment, in the case where it is detected that no item exists at the inlet 311*a* of the hopper 310, the control device 500 controls the hopper driving mechanism 320 of the delivery device 300 to drive the hopper 310 to move to the position of the pickup port 130 so that the user can take the item away through the pickup port 130. During the movement process of the hopper 310, the receiving bin 312 is located at the receiving position, and the baffle 315 prevents the item in the receiving bin 312 from falling out of the receiving bin 312 to the outside of the receiving bin 312. In this way, the stability when the item is delivered can be ensured.

In this embodiment, in the case where it is detected that an item exists at the inlet 311*a* of the hopper 310, the control device 500 controls the receiving bin driving mechanism 314 to drive the receiving bin 312 to rotate from the receiving position to the first position so that the item completely enters the hopper 310. The first position is located between the receiving position and the dispensing position.

In some embodiments, the control device 500 is configured to control the receiving bin 312 to rotate in a first preset direction by a preset angle A1 so that the receiving bin 312 reaches the first position from the receiving position. The first preset direction is the rotation direction of the receiving bin 312 rotating from the receiving position to the dispensing position. The preset angle A1 is obtained in advance through experiments or tests and prestored in the storage device of the vending machine 010. In an embodiment, the preset angle A1 is greater than 0 and less than 45 degrees, and the preset angle A1 satisfies that the baffle 315 does not interfere with the cabinet door 120 during the receiving bin 312 rotating from the receiving position to the first position. Of course, in other embodiments, the vending machine 010 may further include a first sensor configured to detect whether the receiving bin 312 reaches the first position. During the rotation of the receiving bin 312, the control device 500 detects whether the receiving bin 312 reaches the first position according to the signal output by the first sensor. In the case where it is detected that the receiving bin 312 reaches the first position, the control device 500 controls the receiving bin 312 to stop rotating.

Figure 5:
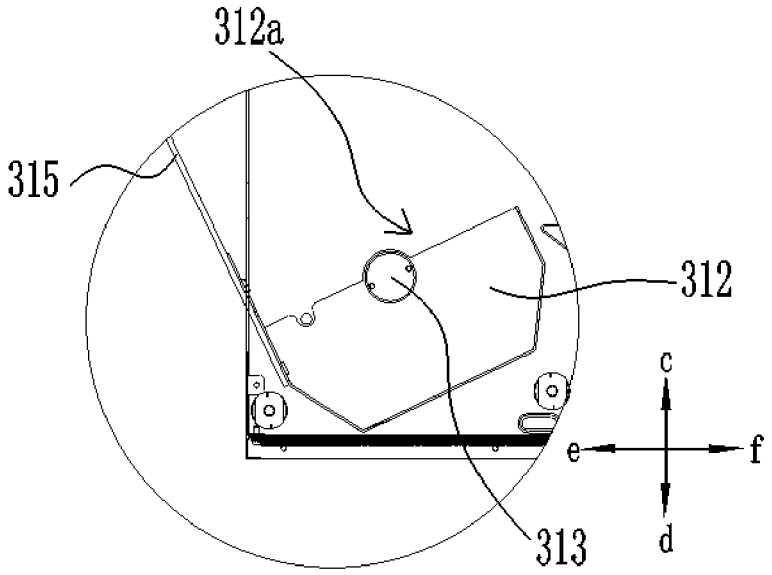
FIG. 5 is a structural schematic view of the hopper of the vending machine according to an embodiment of the present disclosure in the case where the receiving bin is at a first position.

FIG. 5 is a structure view of the hopper of the vending machine according to an embodiment of the present disclosure in the case where the receiving bin is at the first position. As shown in FIGS. 4A, 4B, and 5, in the case where the receiving bin 312 rotates from the receiving position to the first position, the front wall 312*b* of the receiving bin 312 gradually lowers and the rear wall 312*c* of the receiving bin 312 gradually rises so that the front end of the item in the hopper 310 gradually lowers and the rear end of the item gradually rises. In this manner, the bottom end of the tilted item gradually moves toward the outlet 311*b* of the hopper 310 under the guidance of the receiving bin 312 so that the item completely enters the hopper 310. Further, in the case where the item is jammed at the inlet 311*a* of the hopper 310 due to the inclination, the receiving bin 312 rotates from the receiving position to the first position so that the rear wall 312*c* of the receiving bin 312 applies an upward force to the jammed item, and thus the jammed item enter the inside of the hopper 310.

In some embodiments, the control device 500 is further configured to control the speed of the receiving bin 312 rotating from the receiving position to the first position to be below a preset speed. For example, the speed of the receiving bin 312 rotating from the receiving position to the first position is controlled to be less than one-half of the speed of the receiving bin 312 rotating from the receiving position to the dispensing position, further ensuring that under the guidance of the receiving bin 312, the bottom end of the tilted item moves along the bottom plate 312*d* toward the outlet of the hopper 310 so that the item completely enters the hopper 310.

For the vending machine provided in this embodiment, the receiving bin of the hopper is controlled to rotate from the receiving position to the first position in the case where it is detected that an item exists at the inlet of the hopper. The receiving bin rotates so that the front end of the item in the hopper lowers and the rear end of the item rises, and thus under the guidance of the receiving bin, the bottom end of the tilted item moves along the bottom plate of the receiving bin toward the outlet of the hopper. In this manner, the item completely enters the hopper, thereby avoiding the problem that the item in the hopper protrudes from the inlet of the hopper to hinder the normal movement of the hopper, and further ensuring that the hopper can move normally between the item column and the pickup port. Therefore, the problem of the vending machine provided in the related art that the item protrudes from the inlet of the hopper to cause the vending machine to work abnormally can be solved.

In some embodiments, the control device 500 is further configured to control the receiving bin driving mechanism 314 to drive the receiving bin 312 to rotate from the first position to the receiving position after the receiving bin 312 rotates from the receiving position to the first position.

In some embodiments, that the receiving bin 312 is controlled to rotate from the first position to the receiving position includes that the receiving bin 312 is controlled to rotate in a second preset direction by the preset angle A1 so that the receiving bin 312 reaches the receiving position from the first position. The second preset direction is the rotation direction of the receiving bin 312 rotating from the dispensing position to the receiving position. The preset angle A1 is the angle by which the receiving bin 312 rotates from the receiving position to the first position.

Of course, in other embodiments, a second sensor configured to detect whether the receiving bin 312 is located at the receiving position may further be provided. During the rotation of the receiving bin 312, it is detected whether the receiving bin 312 reaches the receiving position according to the signal output by the second sensor. In the case where it is detected that the receiving bin 312 reaches the receiving position, the receiving bin 312 is controlled to stop rotating.

In another embodiment of the present disclosure, the control device 500 is further configured to control the receiving bin 312 to reciprocate at least once. After each reciprocating rotation of the receiving bin 312, it is detected whether an item exists at the inlet of the hopper 310. In the case where an item exists at the inlet of the hopper 310, the receiving bin 312 is controlled to perform the next reciprocating rotation. Each reciprocating rotation of the receiving bin 312 is a process in which the receiving bin 312 rotates from the receiving position to the first position and then from the first position to the receiving position.

For the vending machine provided in this embodiment, in the case where it is detected that an item exists at the inlet of the hopper, the receiving bin is controlled to reciprocate between the receiving position and the first position until the item completely enters the hopper. Therefore, the reliability of the hopper of the vending machine can be improved, ensuring the normal movement of the hopper between the item column and the pickup port. Further, the problem of the vending machine provided in the related art that the item protrudes from the inlet of the hopper to cause the vending machine to work abnormally can be solved.

In another embodiment of the present disclosure, the control device 500 is further configured to detect whether an item exists at the inlet of the hopper 310 after each reciprocating rotation of the receiving bin 312. In the case where it is detected that an item exists at the inlet of the hopper 310, it is determined whether the number of reciprocating rotations of the receiving bin 312 reaches a preset value. In the case where it is determined that the number of reciprocating rotations of the receiving bin 312 does not reach the preset value, the receiving bin 312 is controlled to perform the next reciprocating rotation.

In an embodiment, based on the preceding embodiment, in the case where the receiving bin 312 is controlled to rotate from the first position to the receiving position, the control device 500 is further configured to record the number of reciprocating rotations of the receiving bin 312. In an embodiment, every time the receiving bin 312 is controlled to receive the item from the target item column at the receiving position according to the purchase instruction from the user, the control device 500 sets the number of reciprocating rotations of the receiving bin 312 to zero, and then after each reciprocating rotation of the receiving bin 312, the control device 500 adds 1 to the number of reciprocating rotations of the receiving bin 312.

After the number of reciprocating rotations of the receiving bin 312 is recorded, it is detected whether an item exists at the inlet 311*a* of the hopper 310. In the case where it is determined that an item exists at the inlet 311*a* of the hopper 310, the control device 500 determines whether the number of reciprocating rotations of the receiving bin 312 reaches the preset value before the receiving bin 312 starts the next reciprocating rotation.

In this embodiment, in the case where it is determined that the number of reciprocating rotations of the receiving bin 312 does not reach the preset value, the receiving bin 312 is controlled to perform the next reciprocating rotation. In the case where it is determined that the number of reciprocating rotations of the receiving bin 312 reaches the preset value, the alarm information of the abnormality of the hopper is output. In this embodiment, the control device 500 controls the alarm device 600 to output the alarm information of the abnormality of the hopper.

For the vending machine provided in this embodiment, in the case where the number of reciprocating rotations of the receiving bin 312 reaches the pre-set value, the alarm information of the abnormality of the hopper is output if it is still detected that an item exists at the inlet of the hopper. By using the vending machine provided in this embodiment, the maintenance personnel can learn about the abnormality of the hopper in time and solve the abnormality so that the easy maintenance of the vending machine can be further improved.

In summary, during the item dispensing process of the vending machine provided in the embodiments of the present disclosure, first, the receiving bin is controlled to receive the item from the item column at the receiving position according to the purchase instruction from the user, and then it is detected whether an item exists at the inlet of the hopper. In the case where it is detected that an item exists at the inlet of the hopper, the receiving bin of the hopper is controlled to rotate from the receiving position to the first position. The receiving bin rotates so that the front end of the item in the hopper lowers and the rear end of the item rises, and thus under the guidance of the receiving bin, the tilted items move along the bottom plate of the receiving bin toward the outlet of the hopper. In this manner, the item completely enters the hopper, thereby avoiding the problem that the item in the hopper protrudes from the inlet of the hopper to hinder the normal movement of the hopper, and further ensuring that the hopper can move normally between the item column and the pickup port. Therefore, the problem of the vending machine provided in the related art that the item protrudes from the inlet of the hopper to cause the vending machine to work abnormally can be solved.

What is claimed is:

1. A vending machine, comprising a control device, a cabinet, a pickup port disposed on the cabinet, an item column, and a hopper, wherein the item column and the hopper are disposed inside the cabinet, the hopper is located between the item column and the pickup port, the hopper is configured to deliver items between the item column and the pickup port, the hopper is provided with an inlet and an outlet, the hopper comprises a receiving bin provided with an opening, the receiving bin is rotatable between a receiving position and a dispensing position, the receiving position is a position of the receiving bin when the hopper receives an item from the item column, the dispensing position is a position of the receiving bin when a user takes out the item from the hopper;

the vending machine further comprises a detection device, wherein the detection device is configured to detect whether an item exists at the inlet of the hopper, the detection device is electrically connected to the control device, and the control device is configured to:

control the receiving bin to receive an item from the item column at the receiving position according to a purchase instruction from a user; and detect whether the item exists at the inlet of the hopper, and control the receiving bin to rotate from the receiving position to a first position located between the receiving position and the dispensing position based on a detection result that the item exists at the inlet of the hopper;

wherein the control device is further configured to control the receiving bin to perform reciprocating rotation at least once, and each reciprocating rotation of the receiving bin is a process in which the receiving bin rotates from the receiving position to the first position and then from the first position to the receiving position; and wherein the control device is further configured to, after each reciprocating rotation of the receiving bin, detect whether the item exists at the inlet of the hopper, and control the receiving bin to perform a next reciprocating rotation based on the detection result that the item exists at the inlet of the hopper.

2. The vending machine of claim 1, wherein the control device is configured to:

control the receiving bin to rotate in a first preset direction by a preset angle A1 such that the receiving bin reaches the first position from the receiving position, wherein the first preset direction is a rotation direction of the receiving bin rotating from the receiving position to the dispensing position.

3. The vending machine of claim 2, wherein the control device is further configured to:

control the hopper to move to the pickup port based on a detection result that no item exists at the inlet of the hopper.

4. The vending machine of claim 2, wherein the preset angle A1 is greater than 0 and less than 45 degrees.

5. The vending machine of claim 4, wherein the control device is further configured to:

control the hopper to move to the pickup port based on a detection result that no item exists at the inlet of the hopper.

6. The vending machine of claim 1, further comprising a first sensor configured to detect whether the receiving bin reaches the first position, wherein the control device is configured to:

detect whether the receiving bin reaches the first position based on a signal output by the first sensor and control the receiving bin to stop rotating based on a detection result that the receiving bin reaches the first position.

7. The vending machine of claim 6, wherein the control device is further configured to:

control the hopper to move to the pickup port based on a detection result that no item exists at the inlet of the hopper.

8. The vending machine of claim 1, wherein the control device is further configured to control the receiving bin to rotate from the first position to the receiving position after the receiving bin rotates from the receiving position to the first position.

9. The vending machine of claim 8, wherein the control device is further configured to:

control the hopper to move to the pickup port based on a detection result that no item exists at the inlet of the hopper.

10. The vending machine of claim 1, wherein in a case where the receiving bin is located at the receiving position, the opening of the receiving bin faces upward, and in a case where the receiving bin is located at the dispensing position, the opening of the receiving bin faces to the outlet of the hopper.

11. The vending machine of claim 1, wherein the control device is configured to:

after each reciprocating rotation of the receiving bin, detect whether the item exists at the inlet of the hopper;

determine whether a number of reciprocating rotations of the receiving bin reaches a preset value based on the detection result that the item exists at the inlet of the hopper; and control the receiving bin to perform a next reciprocating rotation based on a determination result that the number of reciprocating rotations of the receiving bin does not reach the preset value.

12. The vending machine of claim 11, wherein the control device is further configured to:

output alarm information of abnormality of the hopper based on a determination result that the number of reciprocating rotations of the receiving bin reaches the preset value.

13. The vending machine of claim 1, wherein the control device is further configured to:

control the hopper to move to the pickup port based on a detection result that no item exists at the inlet of the hopper.

14. The vending machine of claim 1, wherein the item column is provided with an item conveying mechanism, and the item conveying mechanism is configured to drive the item in the item column so that the item in the item column is conveyed out from the item column.

15. The vending machine of claim 1, wherein the hopper further comprises a frame;

the frame is provided with an item accommodation space penetrating forward and backward, end surfaces of the frame are provided with an inlet and an outlet, respectively, the inlet of the frame is disposed opposite to the outlet of the frame, the inlet formed on one of the end surfaces of the frame is the inlet of the hopper, and the outlet formed on another of the end surfaces of the frame is the outlet of the hopper; and the receiving bin is disposed in the item accommodation space, the receiving bin is pivoted to the frame with a shaft, and the receiving bin is rotatable around the shaft relative to the frame.

16. The vending machine of claim 1, wherein one end of the receiving bin facing toward the outlet of the hopper is provided with a baffle; and in a case where the receiving bin is at the receiving position, the baffle faces to the item column; and in a case where the receiving bin is at the dispensing position, the baffle is inserted into the pickup port.

17. The vending machine of claim 16, wherein the control device is further configured to control the receiving bin to be located at the receiving position during a movement process of the hopper.

18. The vending machine of claim 1, further comprising a hopper driving mechanism, wherein the hopper driving mechanism comprises a horizontal driving mechanism and a vertical driving mechanism, the horizontal driving mechanism and the vertical driving mechanism are electrically connected to the control device, and the horizontal driving mechanism and the vertical driving mechanism are in a transmission connection with the hopper; and the horizontal driving mechanism is configured to drive the hopper to move in a left-right direction, and the vertical driving mechanism is configured to drive the hopper to move in an up-down direction.

* * * * *